US011946185B2

(12) United States Patent
Kim et al.

(10) Patent No.: US 11,946,185 B2
(45) Date of Patent: Apr. 2, 2024

(54) LAUNDRY DEVICE

(71) Applicant: LG ELECTRONICS INC., Seoul (KR)

(72) Inventors: Sungmin Kim, Seoul (KR); Jinwoong Kim, Seoul (KR); Hyoungmin Sim, Seoul (KR)

(73) Assignee: LG Electronics Inc., Seoul (KR)

( * ) Notice: Subject to any disclaimer, the term of this patent is extended or adjusted under 35 U.S.C. 154(b) by 15 days.

(21) Appl. No.: 17/769,027

(22) PCT Filed: Dec. 16, 2020

(86) PCT No.: PCT/KR2020/018417
§ 371 (c)(1),
(2) Date: Apr. 14, 2022

(87) PCT Pub. No.: WO2021/125776
PCT Pub. Date: Jun. 24, 2021

(65) Prior Publication Data

US 2023/0033602 A1 Feb. 2, 2023

(30) Foreign Application Priority Data

Dec. 16, 2019 (KR) ..... 10-2019-0167512

(51) Int. Cl.
*D06F 37/10* (2006.01)
*D06F 37/22* (2006.01)
(Continued)

(52) U.S. Cl.
CPC ..... *D06F 37/10* (2013.01); *D06F 37/22* (2013.01); *D06F 37/267* (2013.01); *D06F 37/28* (2013.01); *D06F 37/42* (2013.01); *D06F 39/14* (2013.01)

(58) Field of Classification Search
CPC ..... D06F 37/10; D06F 37/22; D06F 37/267; D06F 37/28; D06F 37/42; D06F 39/14
See application file for complete search history.

(56) References Cited

U.S. PATENT DOCUMENTS

2009/0178445 A1 7/2009 Brinkmann
2016/0326686 A1* 11/2016 Jo ..... D06F 37/28
(Continued)

FOREIGN PATENT DOCUMENTS

CN 101280499 10/2008
CN 107447432 12/2017
(Continued)

OTHER PUBLICATIONS

Electronic translation of KR2007-0064000 A to Jeon. (Year: 2007).*
(Continued)

*Primary Examiner* — Joseph L. Perrin
(74) *Attorney, Agent, or Firm* — Fish & Richardson P.C.

(57) ABSTRACT

The present disclosure relates to a laundry device provided with: a cabinet which includes a front cabinet having a cabinet input hole formed therein; a tub which is installed inside the cabinet and has a tub input hole positioned on an extension line of the cabinet input hole; a cabinet door which is installed in the cabinet and opens and closes the cabinet input hole; a tub door which is installed in the tub and opens and closes the tub input hole; and a gap closing device for opening or closing a gap, formed between the front cabinet and the tub, according to the opening and closing of the tub door.

16 Claims, 11 Drawing Sheets

(51) Int. Cl.

| | |
|---|---|
| ***D06F 37/26*** | (2006.01) |
| ***D06F 37/28*** | (2006.01) |
| ***D06F 37/42*** | (2006.01) |
| ***D06F 39/14*** | (2006.01) |

(56) References Cited

U.S. PATENT DOCUMENTS

| | | | | |
|---|---|---|---|---|
| 2016/0326687 | A1* | 11/2016 | Jo | D06F 39/14 |
| 2018/0073180 | A1* | 3/2018 | Jo | D06F 37/10 |

FOREIGN PATENT DOCUMENTS

| | | |
|---|---|---|
| JP | 2007229219 | 9/2007 |
| KR | 10-2001-0049032 | 6/2001 |
| KR | 10-2001-0089069 | 9/2001 |
| KR | 100529954 | 11/2005 |
| KR | 20070064000 | 6/2007 |
| KR | 20190005502 | 1/2019 |
| RU | 2600430 | 10/2016 |

OTHER PUBLICATIONS

Russian Office Action in RU Application No. 2022109208, dated Dec. 23, 2022, 12 pages (with English translation).
Office Action in Chinese Appln. No. 202080079412.2, dated Mar. 18, 2023, 18 pages (with English translation).
International Search Report and Written Opinion in International Appln. No. PCT/KR2020/018417, dated Apr. 5, 2021, 13 pages (with English translation).

* cited by examiner

LAUNDRY DEVICE

CROSS-REFERENCE TO RELATED APPLICATIONS

This application is a National Stage application under 35 U.S.C. § 371 of International Application No. PCT/KR2020/018417, filed on Dec. 16, 2020, which claims priority to Korean Application No. 10-2019-0167512, filed on Dec. 16, 2019, the contents of which are hereby incorporated by reference herein in their entirety.

TECHNICAL FIELD

The present disclosure relates to a washing machine, and more particularly to a washing machine capable of preventing introduction of foreign objects in to the space between a tub and a cabinet and preventing vibration and noise, which are generated by the tub while the washing machine is operated, from being transmitted to the cabinet.

BACKGROUND ART

Generally, a washing machine is a product configured to eliminate various contaminants from clothes or bedclothes using emulsification of detergent, abrasive action caused by the flow of water generated by rotation of a pulsator or a drum, and impact action applied to the laundry. Full automatic washing machines, which have been developed recently, are designed to automatically perform a series of procedures including a washing course, a rinsing course, a spin-drying course and the like without intervention or manipulation by a user.

The recent trend is toward increasing demand for a drum-type washing machine, which is reduced in overall height and almost completely avoids a problem in which laundry in entangled and a large amount of wrinkles are formed in laundry, compared to a pulsator-type washing machine in which a washing tub is rotated in an erect state.

Briefly explaining a drum-type washing machine, the drum-type washing machine includes a body cabinet defining the appearance of the washing machine, a tub positioned in the body cabinet so as to store washing water therein and supported by a damper and a spring, and a cylindrical drum positioned in the tub and configured to receive laundry therein.

The drum receives driving force from a drive unit configured to perform washing of laundry introduced into the drum. Such a drum-type washing machine necessarily includes a gasket between the opening in the tub and the body cabinet in order to prevent leakage of washing water stored in the tub.

The above-mentioned drum-type washing machine inevitably causes vibration due to the rotational force of the drum, eccentric disposition of laundry or the like while the drum is rotated in order to perform washing and spin-drying procedures for laundry introduced into the drum, and the vibration generated due to rotation of the drum is transmitted to the outside via the tub and the cabinet.

Here, the vibration and noise transmitted to the tub may be transmitted to the cabinet via the gasket configured to ensure a water seal between the cabinet and the tub, thereby causing the cabinet to vibrate and emit noise.

Recently, in order to solve the above-mentioned problem, Korean Unexamined Patent Publication No. 10-2016-0112646 (hereinafter, referred to as a "related document") has proposed a washing machine including a cabinet door and a tub door respectively provided at a cabinet and a tub.

However, because the above-mentioned related document must have a gap defined between a front cabinet or the cabinet door and the tub door for movement of the tub, there is a problem in that a foreign object such as a coin, a button or the like may be introduced into the cabinet of the washing machine through the gap when laundry is introduced into or taken out of the washing machine.

DISCLOSURE

Technical Task

An object of the present disclosure is to provide a washing machine, which has an improved structure between a tub and a cabinet so as to prevent vibration and noise of the tub from being transmitted to the cabinet.

Another object of the present disclosure is to provide a washing machine, which is improved with regard to an interior structure between a cabinet and a tub so as to increase the capacity of the tub compared to a conventional structure.

Yet another object of the present disclosure is to provide a washing machine configured to shield a gap defined between a cabinet door and a tub door to prevent foreign objects from entering the gap between the cabinet door and the tub door.

Still yet another object of the present disclosure is to provide a washing machine configured to selectively shield a gap between a cabinet door and a tub door in response to opening and closing of a cabinet to prevent foreign objects from entering the gap between the cabinet door and the tub door.

The objects of the present disclosure are not limited to the above-mentioned objects, and other objects of the present disclosure, which are not mentioned above, will be clearly understood by those skilled in the art from the following descriptions.

Technical Solutions

In order to accomplish the above objects, a washing machine according to an embodiment of the present disclosure includes a cabinet including a front cabinet in which a cabinet introduction port is formed, a tub disposed in the cabinet and having a tub introduction port coaxially positioned with the cabinet introduction port, a cabinet door mounted on the cabinet so as to open and close the cabinet introduction port, a tub door mounted on the tub so as to open and close the tub introduction port, and a gap-shielding device configured to open and close a gap defined between the front cabinet and the tub in response to opening and closing of the tub door.

The washing machine may further include a cabinet door lock provided at the cabinet and configured to set the locked state of the cabinet door, and a tub door lock provided at the tub and configured to set a locked state of the tub door.

The tub door lock may set the locked state of the tub door in response to opening and closing of the cabinet door lock.

The gap-shielding device may be operated in response to opening and closing of the cabinet door, and shields the gap when the cabinet door is open.

The gap-shielding device may include a base fixed to the front cabinet, a movable body provided at the base so as to be movable in the radial direction of the cabinet introduction port, an actuator provided at the base so as to move the movable body, and a shielding end configured to be moved into the gap to thus shield the gap by movement of the movable body.

The shielding end may include a concave surface extending along the circumferential surface of the cabinet introduction port.

The shielding end may be integrally formed with the movable body.

The shielding end may be elastically biased toward the front cabinet, and the movable body pushes and moves the shielding end toward the gap.

The front cabinet may include a plurality of shielding-end-holding portions, and the shielding end may include a plurality of slide holes corresponding to the plurality of shielding-end-holding portions, the plurality of shielding-end-holding portions respectively inserted into the plurality of slide holes and fixed to the shielding end, and a plurality of springs respectively interposed between the plurality of slide holes and the shielding-end-holding portions so as to bias the shield end toward the front cabinet.

The shielding end may include a sloping surface formed on the surface of the shielding end opposite the concave surface so as to move the shielding end toward the gap by pressure from the movable body.

The movable body may include a slide sloping surface formed at an end thereof, the slide sloping surface coming into contact with the sloping surface and moving the shielding end.

The actuator may move the movable body in response to opening and closing of the cabinet door lock.

The cabinet introduction port may include a rib extending toward the tub, the tub may include a weight balancer, and the gap-shielding device may shield the gap between the rib and the weight balancer.

The tub may further include a weight balancer cover covering the weight balancer, and the gap-shielding device may shield the gap between the rib and the weight balancer cover.

Advantageous Effects

The washing machine according to the present disclosure offers an effect in that, since the structure between the tub and the cabinet is improved so as to prevent vibration and noise generated in the tub from being transmitted to the cabinet, it is possible to reduce vibration and noise generated by the cabinet and to prevent the unpleasant vibration and noise from being transmitted to a user.

Furthermore, the washing machine according to the present disclosure offers an effect of increasing the capacity of the tub due to improvement in the structure between the tub and the cabinet.

In addition, the washing machine according to the present disclosure offers an effect of shielding the gap defined the cabinet door and the tub door to thus prevent foreign objects from entering the gap between the cabinet door and the tub door.

Furthermore, the washing machine according to the present disclosure offers an effect of preventing foreign objects from entering the gap between the cabinet door and the tub door since the gap between the cabinet door and the tub door is selectively closed depending on whether the cabinet door is open or closed.

The effects of the present disclosure are not limited to the above-mentioned effects, and other effects of the present disclosure, which are not mentioned above, will be clearly understood by those skilled in the art from the attached claims.

BEST MODE FOR DISCLOSURE

Figure 1:
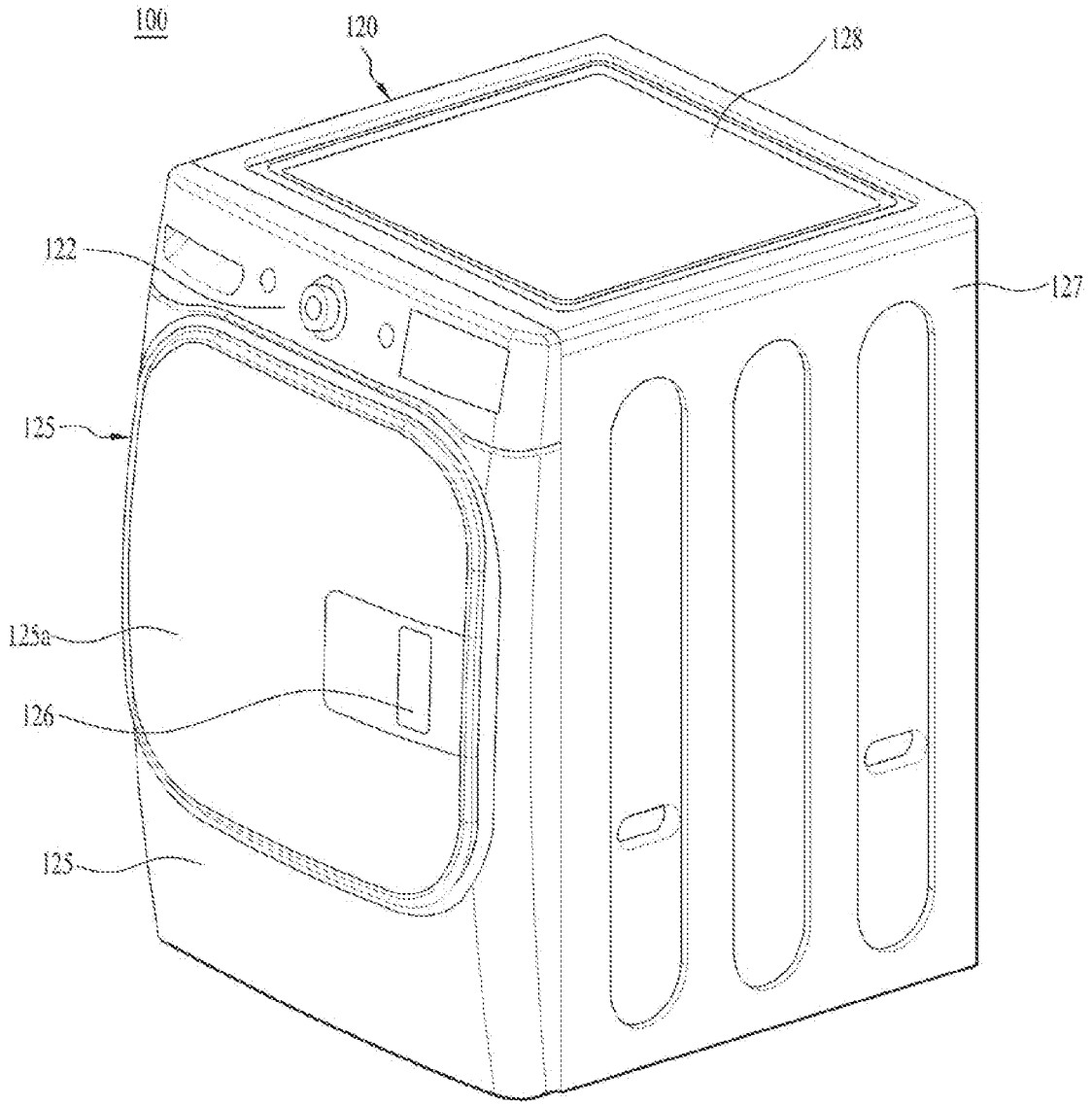
FIG. 1 is a perspective view illustrating the washing machine according to an embodiment of the present disclosure.

Hereinafter, a washing machine according to the present disclosure will be described in detail with reference to the accompanying drawings.

In the description of the present disclosure, the names of components disclosed in the present closure are defined in consideration of functions in the present disclosure. Accordingly, the names of the components should not be construed as limiting the components. Furthermore, the components defined by the names may be referred to using other names in a relevant technical field.

Regardless of reference numerals, the same or similar elements are denoted by the same reference numerals irrespective of their reference numerals, and a redundant description thereof is omitted. For clarity of description, the shapes and sizes of components in the drawings may be exaggerated or scaled down.

It will be understood that although the terms "first", "second", etc. may be used herein to describe various elements, these elements should not be construed as being limited by these terms. These terms are only used to distinguish one element from another.

In this specification, it should be understood that, when an element is referred to as being "connected with" another element, there may be intervening elements present, or the element may be directly connected with the another element. In contrast, it should be understood that, when an element is referred to as being "directly connected with" another element, there are no intervening elements present.

In this specification, terms such as "includes" or "has" used herein should be considered as indicating the presence of various features, numbers, steps, operations, elements, components or combinations thereof disclosed in the specification, but it should be understood that the presence or addition of one or more other features, numbers, steps, operations, elements, components or combinations thereof is not excluded.

In this specification, the term "and/or" includes a combination of a plurality of listed items or any of a plurality of listed items. In this specification, "A or B" may include "A", "B" or "both A and B".

First, the washing machine of an embodiment of the present disclosure will be briefly described with reference to the accompanying drawings.

Figure 2:
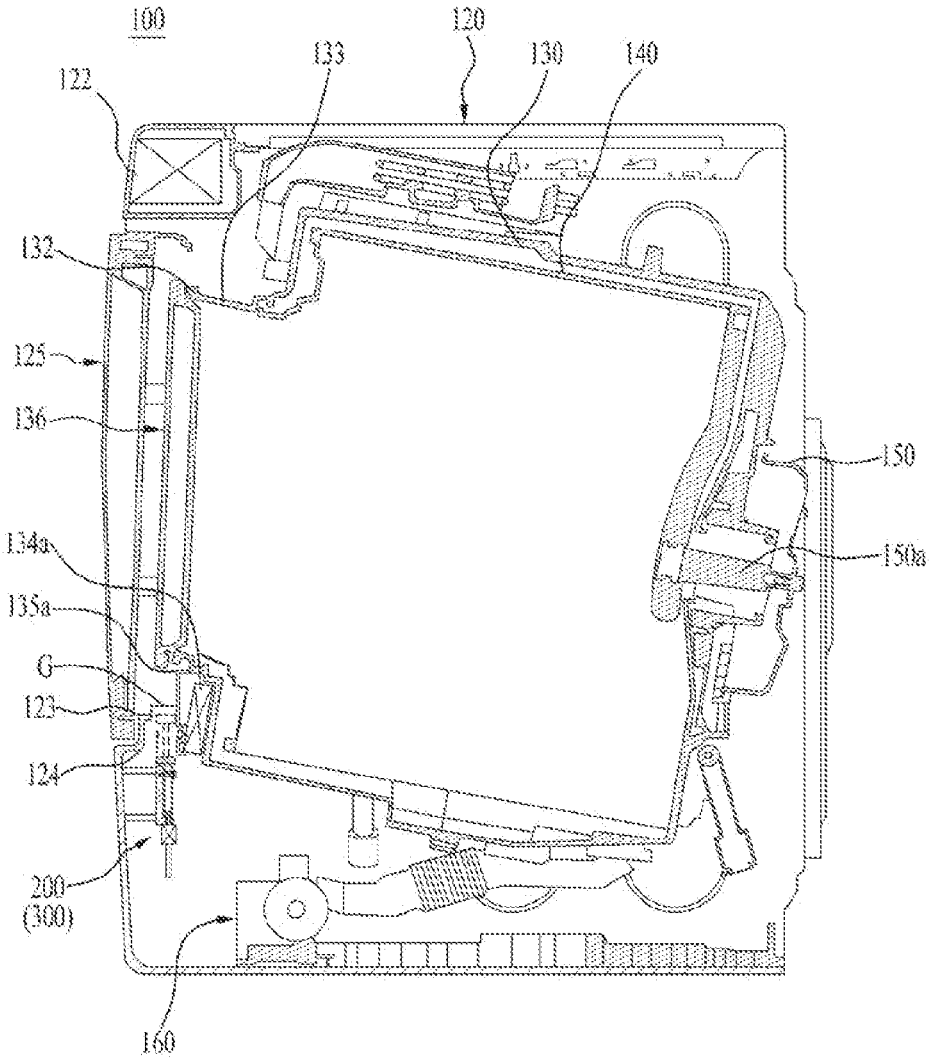
FIG. 2 is a cross-sectional view illustrating the washing machine according to an embodiment of the present disclosure.
Figure 3:
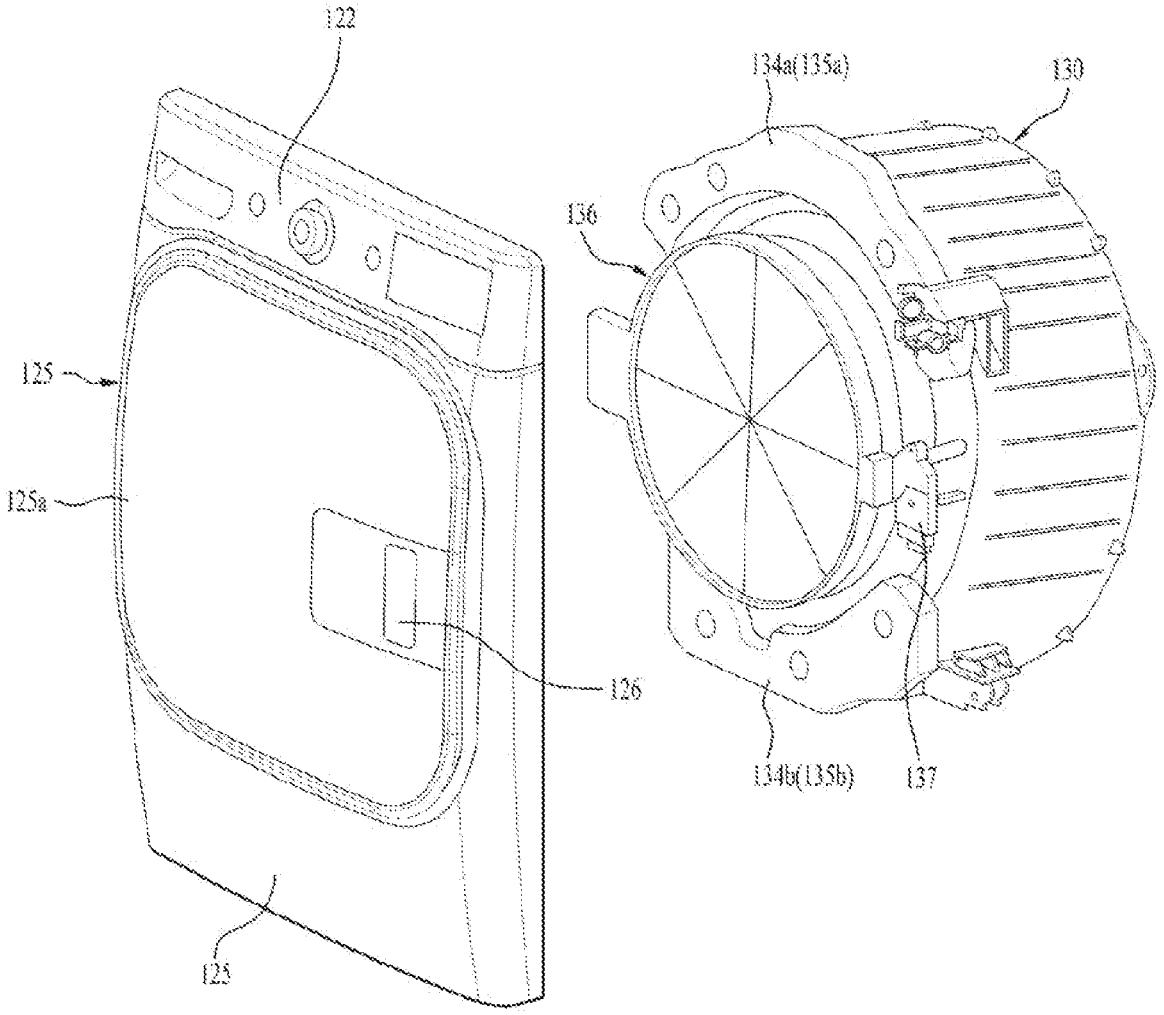
FIG. 3 is an exploded perspective view illustrating substantial components of the washing machine according to an embodiment of the present disclosure.

FIG. 1 is a perspective view illustrating the washing machine according to an embodiment of the present disclosure. FIG. 2 is a cross-sectional view illustrating the washing machine according to an embodiment of the present disclosure. FIG. 3 is an exploded perspective view illustrating substantial components of the washing machine according to an embodiment of the present disclosure.

As illustrated in FIGS. 1 to 3, the washing machine 100 according to the present disclosure includes a cabinet 120 defining the appearance thereof, a tub 130 (see FIGS. 2 and 3) supported by a suspension such as a damper/spring in the cabinet 120 so as to store washing water, a drum 140 rotatably disposed in the tub 130 so as to contain laundry therein, and a motor 150 configured to rotate the drum 140.

The cabinet 120 may include a front cabinet 121 defining the front surface of the washing machine, a side cabinet 127 defining the right and left surfaces of the washing machine, and an upper cabinet 128 defining the upper surface of the washing machine.

Here, the front cabinet 121 is provided in the center thereof with a cabinet introduction port 123, through which laundry is introduced into the washing space in the drum 140, and a cabinet door 125, configured to open and close the cabinet introduction port 123.

As illustrated in FIGS. 2 and 3, the tub 130 includes a tub introduction port 132, which is positioned coaxially with the cabinet introduction port 123 in the state of being isolated from the cabinet introduction port 123 in the cabinet 120 and through which laundry is introduced. A tub door 136 is provided at one side of the tub introduction port 132 so as to open and close the tub introduction port 132.

The present disclosure is directed to the cabinet door 125 and the tub door 136. Therefore, a detailed description of other components (for example, the drum 140, the suspension, a water supply unit, a water discharge unit, and the like) is omitted.

The upper side of the front cabinet 121 (that is, the upper side of the cabinet introduction port 123) may be provided with a control panel 122 including a manipulation unit configured to control the overall operation of the washing machine 100 and a display unit configured to display the state of operation of the washing machine 100.

As illustrated in FIG. 3, the cabinet door 125 is hingedly coupled to one side of the cabinet introduction port 123 so as to open the cabinet introduction port 113 in a rotating manner. The side of the cabinet door 125 that is opposite the side at which the cabinet door 125 is hingedly coupled is provided with a handle 126 configured to enable a user to open and close the cabinet door 125.

A release lever (not shown) is provided inside the handle 126 so as to release the locked state of the cabinet door 125. Furthermore, a cabinet door lock (not shown) may be provided at a predetermined position of one side of the cabinet introduction port 123 corresponding to the release lever.

Here, the front cabinet 121, which has therein the cabinet introduction port 125, includes a door mount 124 on which the cabinet door 125 is seated when the cabinet door 125 closes the cabinet introduction port 123.

The door mount 124 may be formed by being bent toward the inside of the cabinet 120 from the outer circumferential surface of the cabinet introduction port 123. The inner circumferential surface of the door mount 124 (that is, the inner circumferential surface of the cabinet introduction port 123) may be further provided with a ring-shaped rib 123*a* extending toward the tub 130.

The tub introduction port 151, which is positioned in front of the tub 130, is provided with a ring-shaped rim portion 133 projecting toward the front cabinet 121. Upper and lower weight balancers 134*a* and 134*b* are provided above and below the rim portion 133 so as to increase the mass of the tub 130 and thus to prevent vibration of the tub 130. The upper and lower weight balancers 134*a* and 134*b* may be respectively provided with upper and lower weight balancer covers 135*a* and 135*b* so as to shield the upper and lower weight balancers 134*a* and 134*b*.

The tub door 136 may be composed of a plurality of frames, which constitute the outer surface and the inner surface of the tub door 136. The tub door 136 may further be provided on the rear surface thereof with a gasket (not shown) to provide a seal between the rear surface and the tub introduction port 132, and the tub door 136 may be provided in the center thereof with a transparent portion (not shown) so as to allow a user to visually check the state of the interior of the tub 130.

The tub door 136 is hingedly coupled to one side of the rim portion 133 so as to open and close the tub introduction port 132, and a tub door lock 137 may be provided at the opposite side of the rim portion 133 so as to set the locked state of the tub door 136.

The tub door lock 137 of the tub door 136, which is intended to electrically control opening and closing of the tub door 136, may include a tub hook (not shown) provided at the tub door 136. The tub door lock 137 may lock and release the tub hook provided at the tub door 136 under electrical control.

The tub door lock 137 is provided with an additional actuator (for example, a solenoid or the like, not shown), which is operated to release the locked state of the tub door 136. The actuator is electrically or physically connected to the cabinet door lock so as to set the locked state of the tub door lock 136 in response to setting or release of the locked state of the cabinet door lock of the cabinet door 125.

The tub door 136 may be hingedly coupled to the tub introduction port 132, and may always be subjected to elastic force by an additional elastic element in the direction in which the tub door 136 is opened. Accordingly, when the locked state of the tub door 136 by the tub door lock 137 is released, the cabinet door 125 is biased by the elastic force in the direction in which the cabinet door 125 is opened. In other words, when the locked state of the tub door lock 137 is released, the cabinet door 125 may be opened together with the tub door 136.

In the washing machine 100 according to the present disclosure, in order to minimize transmission of vibration of the tub 130 to the cabinet 120, the tub 130 is supported by means of suspension, and the tub 130 vibrates independently due to rotation of the drum 140 in the state of being supported by the suspension.

In other words, because only the suspension is provided but an additional component (for example, a gasket configured to form a water seal between the front cabinet 121 and the tub 130) is not provided between the tub 130 and the cabinet 120, as in a conventional washing machine 100, whereby the tub 130 is completely supported only by the suspension, it is possible to remarkably reduce transmission of the vibration of the tub 130 to the cabinet 120.

A predetermined gap G is defined between the front cabinet 121 equipped with the cabinet door 125 and the front portion of the tub 130 equipped with the tub door 136 so as to allow the tub 130 to vibrate independently.

The above-mentioned gap G may be the distance between the rib 123*a* formed at the front cabinet 121 and the rim portion 133 formed at the tub 130. Alternatively, the gap G may be the distance between the rib 123*a* formed at the front cabinet 121 and the lower weight balancer 134*b* attached to the tub 130. In yet another alternative, the gap G may be the distance between the rib 123*a* formed at the front cabinet 121 and the lower weight balancer cover 135*b* covering the lower weight balancer 134*b* attached to the tub 130.

For convenience of explanation, the washing machine will be described based on an embodiment in which the gap G is defined between the front cabinet 121 and the lower weight balancer cover 135*b*. However, the formation of the gap G is not limited thereto, and the gap G may be defined between the front cabinet 121 and the rim portion 133 of the tub 130 or between the front cabinet 121 and the lower weight balancer 134*b*.

In the above-mentioned embodiment in which the gap G is defined between the front cabinet 121 and the lower weight balancer cover 135*b*, there may be the case in which a foreign object such as a coin, a button or the like is unintentionally introduced into the gap G when laundry is introduced into and taken out of the washing machine.

Accordingly, in order to prevent foreign objects from being introduced into the gap between the front cabinet 121 and the tub 130, the washing machine may further include a gap-shielding device 200 or 300 configured to selectively shield the gap defined between the front cabinet 121 and the tub 130.

The gap-shielding device 200 or 300 may be configured so as to expose the gap between the front cabinet 121 and the lower weight balancer cover 135*b* to thus ensure a space for vibration of the tub 130 when the washing machine 100 is operated and so as to shield the gap between the front cabinet 121 and the lower weight balancer cover 135*b* only when the washing machine is not operated or when laundry is introduced into or taken out of the washing machine.

Specifically, the gap-shielding device 200 or 300 may be configured so as to shield the gap between the front cabinet 121 and the lower weight balance cover 135*b* in response to opening of the cabinet door 125.

In other words, the cabinet door lock, which is configured to enable or disable opening and closing of cause the cabinet door 125, and the tub door lock 137, which is configured to enable or disable opening and closing of the tub door 136, are electrically or physically connected to each other, the tub door 136 is opened and closed in response to opening and closing of the cabinet door 125.

Accordingly, because the gap-shielding device 200 or 300 is electrically or physically connected to the cabinet door lock or the tub door lock 137, the gap-shielding device 200 or 300 is capable of shielding the gap G between the front cabinet 121 and the lower weight balancer cover 135*b* when the cabinet door 125 or the tub door 136 is opened.

In the following embodiment, the gap-shielding device 200 or 300 is described as shielding the gap G between the front cabinet 121 and the lower weight balancer cover 135*b* when the cabinet door lock is actuated so as to open the cabinet door 125.

However, operation of the gap-shielding device 200 or 300 may not be limited thereto, and may be performed in response to actuation of the tub door lock 137. Alternatively, the gap-shielding device 200 or 300 may be operated when an additional sensor (not shown) detects opening and closing of the cabinet door 125 or the tub door 136.

Hereinafter, the gap-shielding device 200 according to an embodiment of the present disclosure will be described in detail with reference to the accompanying drawings.

Figure 4:
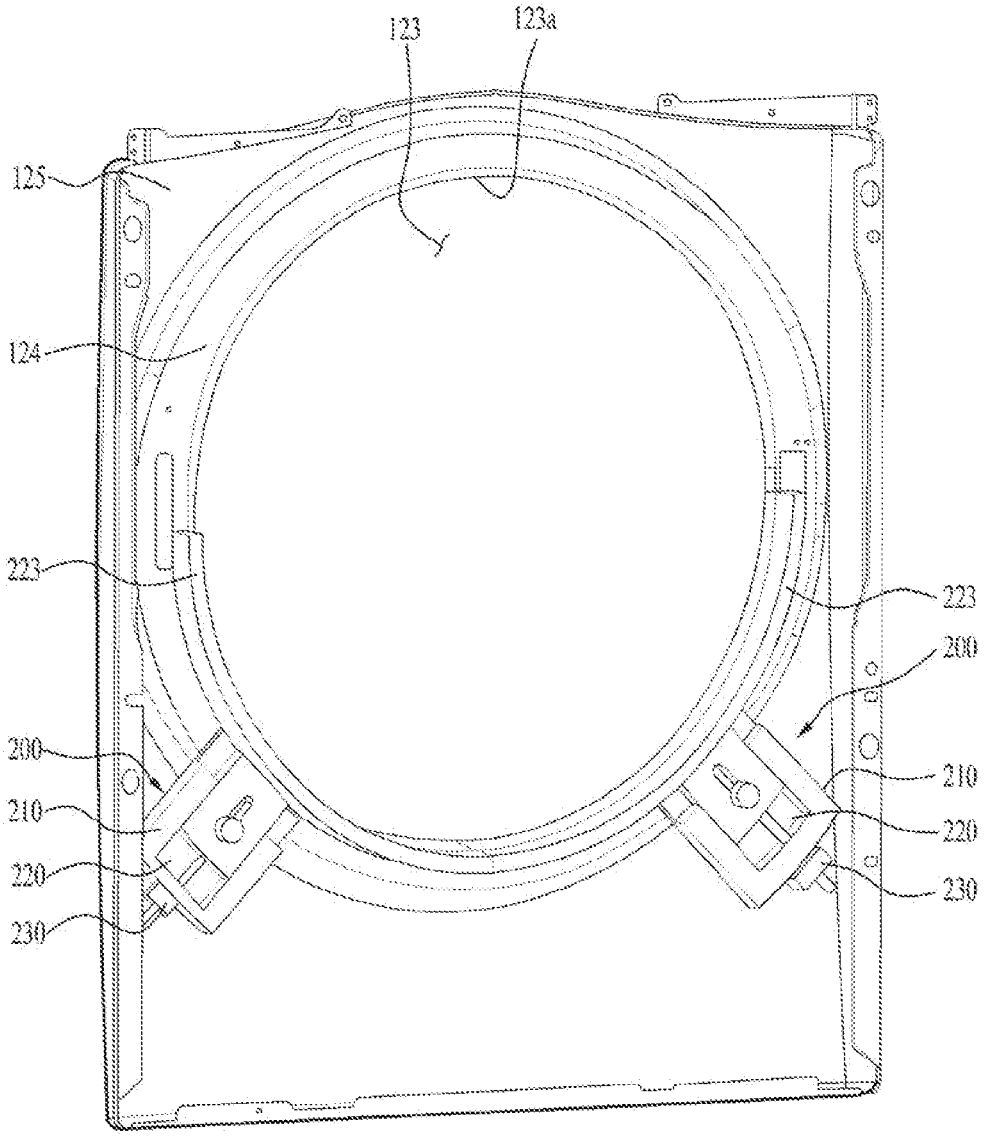
FIG. 4 is a rear view illustrating the gap-shielding device according to an embodiment of the present disclosure.
Figure 5:
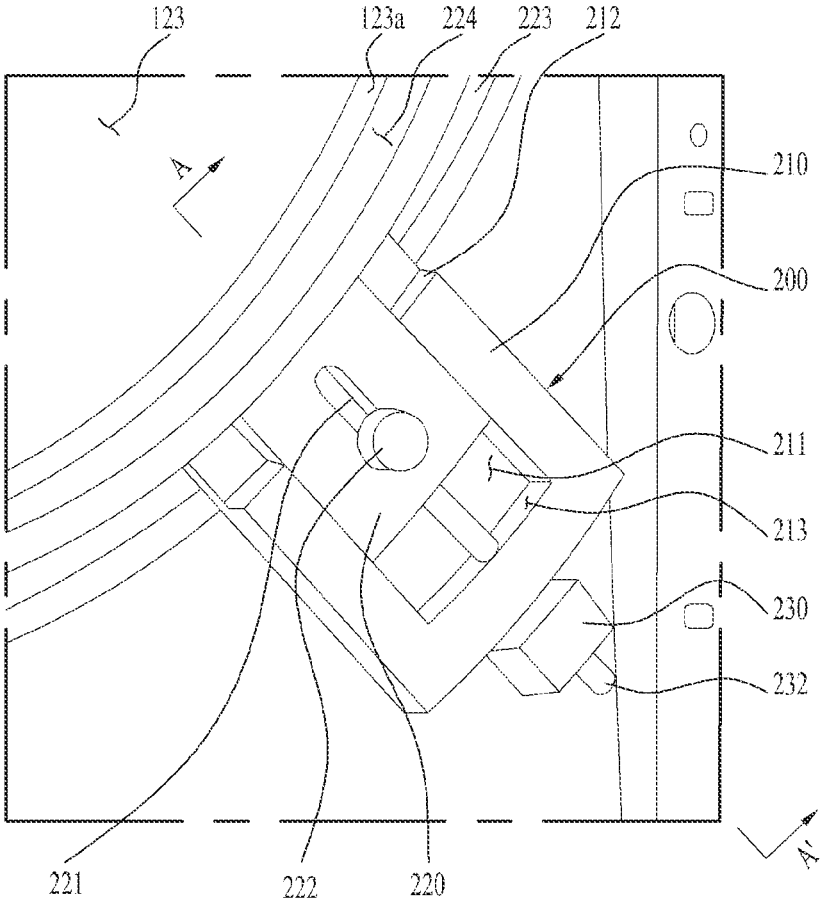
FIG. 5 is an enlarged view illustrating the gap-shielding device according to an embodiment of the present disclosure.
Figure 6:
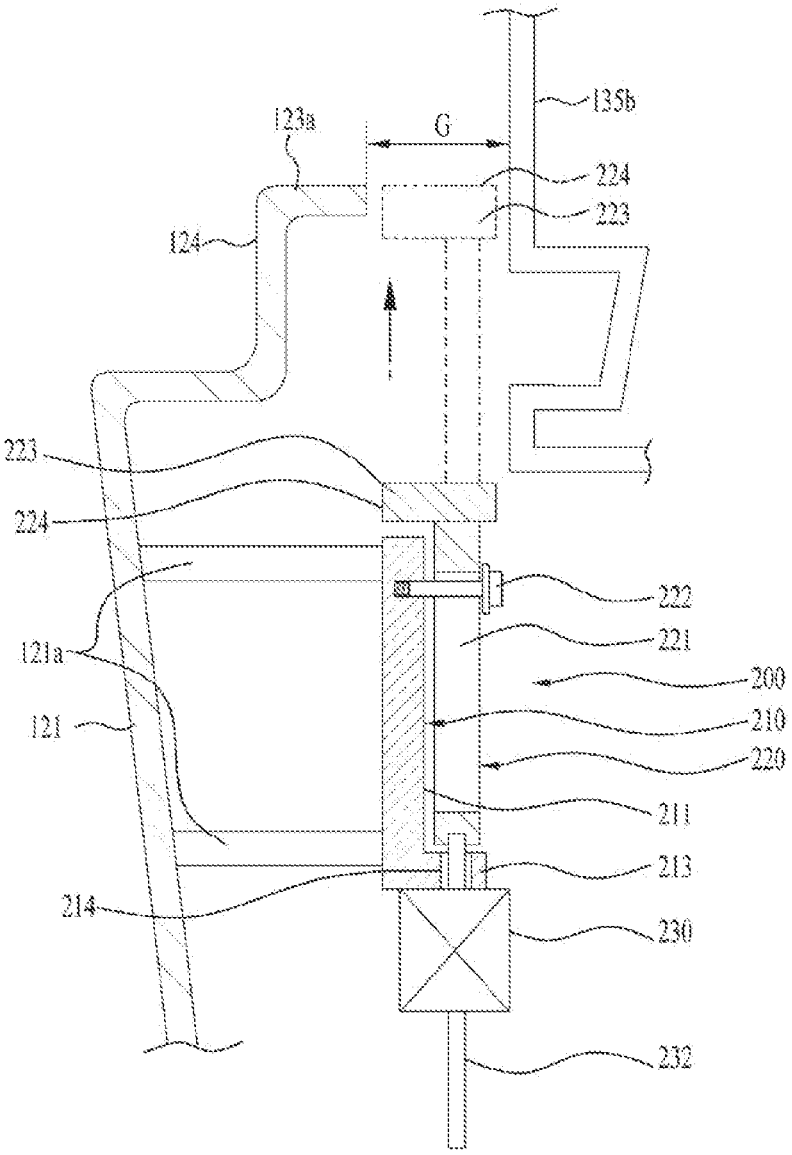
FIG. 6 is a cross-sectional view taken along line A-A' in FIG. 5.

FIG. 4 is a rear view illustrating the gap-shielding device according to an embodiment of the present disclosure. FIG. 5 is an enlarged view illustrating the gap-shielding device according to an embodiment of the present disclosure. FIG. 6 is a cross-sectional view taken along line A-A' in FIG. 5.

As illustrated in the drawings, the gap-shielding device 200 according to an embodiment of the present disclosure is provided between the front cabinet 121 and the lower weight balancer cover 135*b* so as to shield the gap G defined between the front cabinet 121 and the lower weight balancer cover 135*b*.

The gap-shielding device 200 may include a pair of gap-shielding devices, which are symmetrically disposed at two opposite sides below the inner surface of the front cabinet 121 so as to shield the gap G defined between the rib 123*a* of the front cabinet 121 and the lower weight balancer cover 135*b* provided at the tub 130 through the same up-and-down movement thereof. Accordingly, hereinafter, only one of the pair of gap-shielding device 200 will be described as a representative of the gap-shielding device.

The above-described gap-shielding device 200 is provided on the rear surface of the front cabinet 121, and the cabinet introduction port 123 of the front cabinet 121 projects toward the tub 130 by the door mount 124 and the rib 123*a* thereof.

Accordingly, in the case of the gap-shielding device 200 mounted on the front cabinet 121, the gap-shielding device 200 may further include a fixing boss 121*a* to cause the gap-shielding device 200 to be spaced apart from the front cabinet 121 by a distance corresponding to the length of the door mount 124 and the rib 123*a*.

The gap-shielding device 200 includes a base 210 fixed to the fixing boss 121*a*, a movable body 220 configured to be moved toward the center of the cabinet introduction port 123 along the base 210 to thus shield the gap G between the front cabinet 121 and the lower weight balancer cover 135*b*, an actuator configured to move the movable body 220, and a shielding end 223 configured to be moved together with the movable body 220 to thus shield the gap between the front cabinet 121 and the tub 130.

The base is fixed at one surface thereof to the fixing boss 121*a* by means of an additional fastening element, and is provided on the other surface thereof with a moving surface 211 on which the movable body 220 is moved. The moving surface 211 is provided at a lateral side surface thereof with a support 213 configured to guide movement of the movable body 220.

Here, the support 213 may project from three outer lateral side surfaces of the moving surface 211, excluding the outer lateral side surface of the moving surface 211 that faces the cabinet introduction port 123, among the four outer lateral side surfaces of the moving surface 211. The two ends of the support 213 that face the cabinet introduction port 123 are provided with stop steps 212 configured to limit movement of a shielding end 223 of the movable body 220 which will be described later.

Among the three support parts of the support 213 of the base 210, the support part that faces the cabinet introduction port 123 may be provided with an actuator 230 configured to move the movable body 220. Here, the actuator 230 may be embodied as a motor, a solenoid or the like, and may be replaced with another component configured to generate power required to move the movable body 220.

Furthermore, among the support parts 213 of the base 210, the support part that faces the cabinet introduction port 123 may have formed therein a shaft hole 214 through which a drive shaft 232 provided at the movable body 220 extends. The movable body 220 may be moved toward the center of the cabinet introduction port 123 along the moving surface 211 of the base 210 by means of the drive shaft 232, which extends and moves through the shaft hole 214.

Here, the base 210 is positioned on a line which is inclined downwards at an angle of 45° with respect to a vertical line that extends through the center of the cabinet introduction port 123. In other words, the pair of gap-shielding devices 200 may be symmetrically positioned at two opposite sides below the cabinet introduction port 123.

Because the movable body 220 is placed on the base 210 and is moved in the radial direction of the cabinet introduction port 123, the movable body 220 is preferably positioned on a line which is inclined downwards at an angle of 45° with respect to a vertical line that extends through the center of the cabinet introduction port 123, in consideration of the moving direction of the movable body 220 and the shape of the shielding end 223.

The movable body 220 is formed into a shape corresponding to the inner lateral side surface of the support 213 formed at the base 210 so as to be placed and moved on the moving surface of the base 210. The movable body 220 has formed therein a moving slot 221 parallel to the moving direction of the movable body 220 (that is, the radial direction of the cabinet introduction port 123).

The base 210 is provided with a guide 222, which extends through the moving slot 221 and is fixed to the base 210. Consequently, the distance that the movable body 220 is movable is limited by the guide 222 and the moving slot 221.

The end of the movable body 220 that faces the cabinet introduction port 123 is provided with the shielding end 223, which extends in a circumferential direction of the cabinet introduction port 123. The shielding end 223 substantially shields the gap G between the front cabinet 121 and the lower weight balancer cover 135*b*.

Specifically, the shielding end 223 is positioned at one side below the cabinet introduction port 123 in the front cabinet 121. Preferably, the shielding end 223 may be formed into an arc shape, which extends from the center below the cabinet introduction port 123 to an angle of 90°.

The shielding end 223, which is intended to shield the gap G defined between the cabinet introduction port 123 (specifically, the rib 123*a*) and the lower weight balancer cover 135*b*, is formed into an arc shape, which extends along the inner circumferential surface of the cabinet introduction port 123, so as to have a concave surface 224 having the same radius as the radius of the cabinet introduction port 123.

As described above, the gap-shielding device 200 may include a pair of gap-shielding devices 200, which are symmetrically positioned below the cabinet introduction port 123. Accordingly, according to this embodiment, the shielding ends 223 are symmetrically positioned based on a line which extends through the center of the cabinet introduction port 123.

Consequently, because the pair of gap-shielding devices 200 are symmetrically positioned at two opposite sides below the cabinet introduction port 123, the shielding ends 223 of the pair of gap-shielding devices 200 are capable of shielding and opening the two opposite sides below the cabinet introduction port 123.

The shielding end 223 may be integrally formed with the movable body 220, and may be moved together with the movable body 220 in the radial direction of the cabinet introduction port 123 when the movable body 220 is moved. The movable body 220 may be fastened to the center of the rear surface of the concave surface 224 of the shielding end 223, or may be integrally formed with the shielding end 223 at the center of the rear surface of the concave surface 224.

Consequently, when the movable body 220 is moved in the radial direction of the cabinet introduction port 123, the shielding end 223 is moved together with the movable body 220 in the radial direction of the cabinet introduction port 123, thereby shielding the gap between the front cabinet and the lower weight balancer cover 135*b*.

Hereinafter, operation of the gap-shielding device according to an embodiment of the present disclosure will be described in detail with reference to the accompanying drawings.

Figure 7:
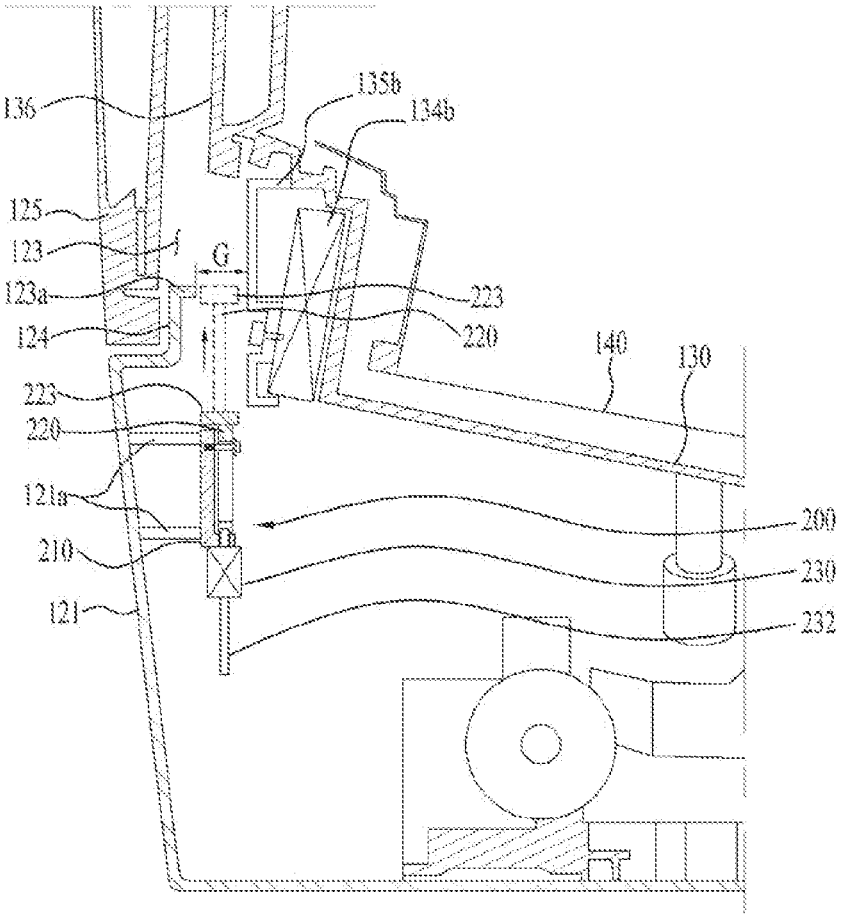
FIG. 7 is a schematic view illustrating operation of the gap-shielding device according to an embodiment of the present disclosure.

FIG. 7 is a schematic view illustrating the operation of the gap-shielding device according to an embodiment of the present disclosure.

As illustrated in the drawings, the gap-shielding device 200 may be actuated in response to opening and closing of the cabinet door 125 or the tub door 136. In the following embodiment, the gap-shielding device 200 is described as being operated in response to opening of the cabinet door 125. However, the operation of the gap-shielding device 200 is not limited thereto, and the gap-shielding device 200 may be operated by detecting opening of the cabinet door 125 or the tub door 136.

First, the initial state of the gap-shielding device 200 is described. As illustrated in the drawings, in the initial state of the gap-shielding device 200, there is a need to ensure a space in which the tub 130 is movable while the washing machine 100 performs a washing procedure, a rinsing procedure, a spinning procedure, a drying procedure and the like in the state in which the cabinet door 125 and the tub door 136 of the washing machine 100 are closed.

Accordingly, when the cabinet door 125 is closed, the movable body 220 is moved in the radially outward direction of the cabinet introduction port 123 based on the base 210 by actuation of the actuator 230, and thus the shielding end 223, which is provided at the movable body 220, is moved from the gap G between the front cabinet 121 and the lower weight balancer cover 135*b* by the movement of the movable body 220.

Here, because the shielding end 223 is formed into an arch shape having the same radius as the radius of the cabinet introduction port 123, when the movable body 220 is moved, the entire shielding end 223 is moved in the radial direction of the cabinet introduction port 123 from the gap G between the cabinet introduction port 123 and the lower weight balancer cover 135*b*, thereby ensuring the gap G between the front cabinet 121 and the lower weight balancer cover 135*b*.

When a user opens the cabinet door 125 in order to introduce laundry into the washing machine 100 or take the laundry out of the washing machine 100, the cabinet door lock, configured to set the locked state of the cabinet door 125, is released.

Consequently, the actuator 230 of the gap-shielding device 200, which is electrically or physically connected to the cabinet door lock, is actuated to move the movable body 220 toward the center of the cabinet introduction port 123 in the radial direction of the cabinet introduction port 123. By virtue of the movement of the movable body 220, the shielding end 223 provided at the movable body 220 becomes positioned in the gap G between the front cabinet 121 and the lower weight balancer cover 135*b*.

Here, because the shielding end 233 is formed into an arc shape having the same radius as the cabinet introduction port 123, when the movable body 220 is moved toward the center of the cabinet introduction port 123, the shielding end 223 is capable of shielding the gap G between the cabinet introduction port 123 and the lower weight balancer cover 135*b*.

Hereinafter, a gap-shielding device according to another embodiment of the present disclosure will be described in detail with reference to the accompanying drawings.

Figure 8:
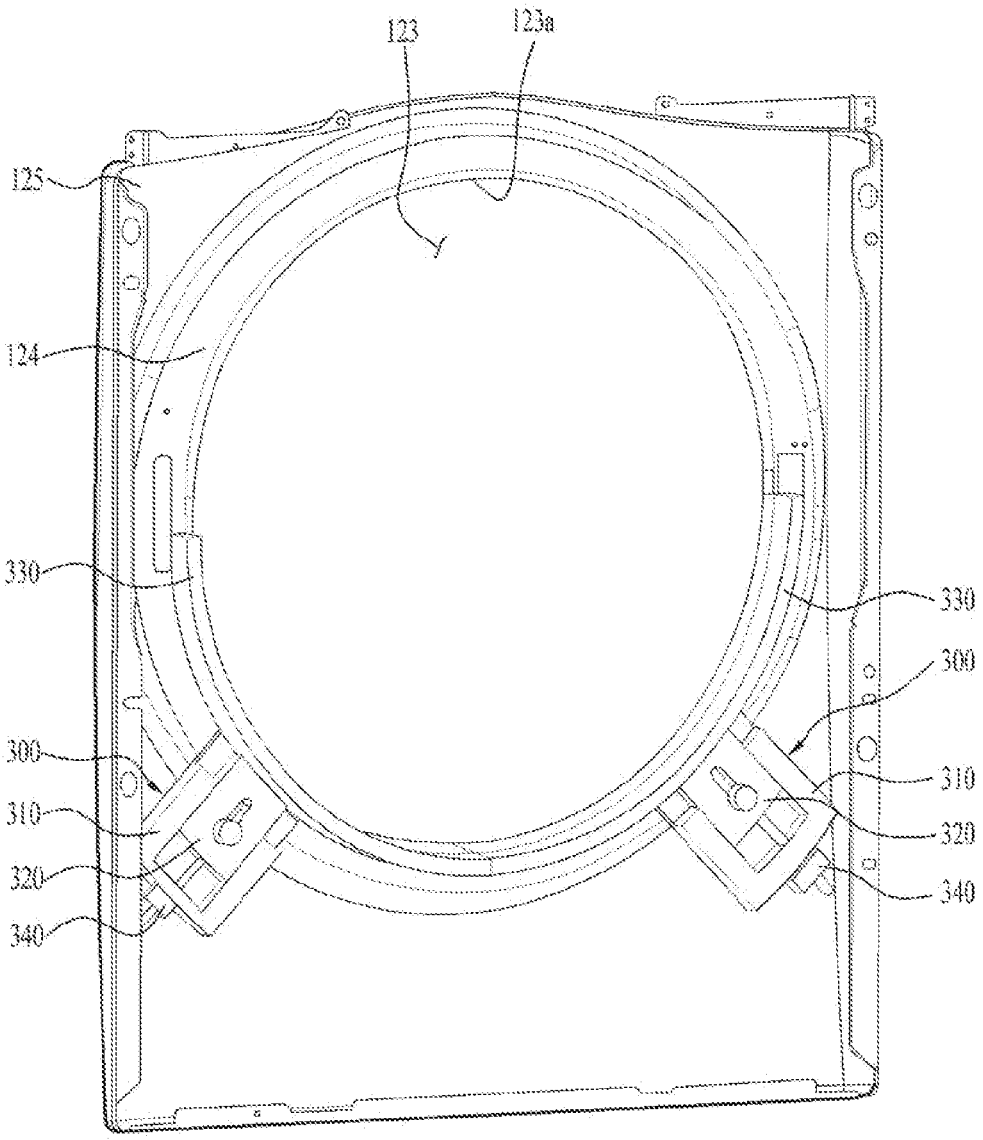
FIG. 8 is a rear view illustrating the gap-shielding device according to another embodiment of the present disclosure.
Figure 9:
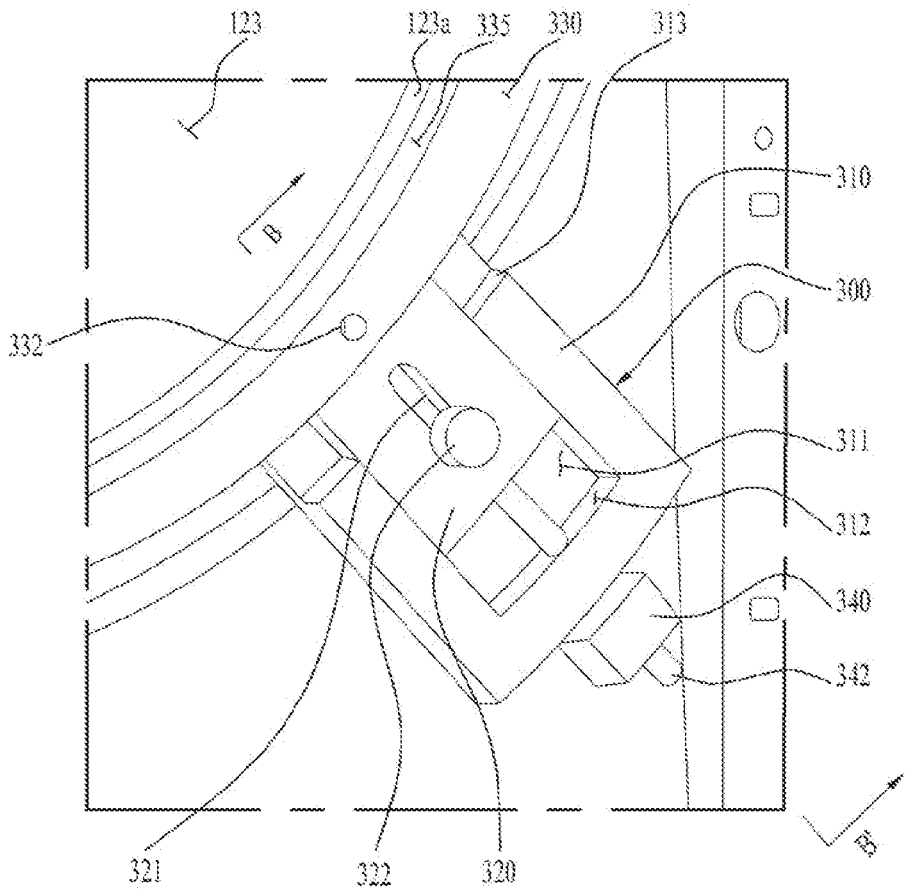
FIG. 9 is an enlarged view illustrating the gap-shielding device according to the embodiment of present disclosure.
Figure 10:
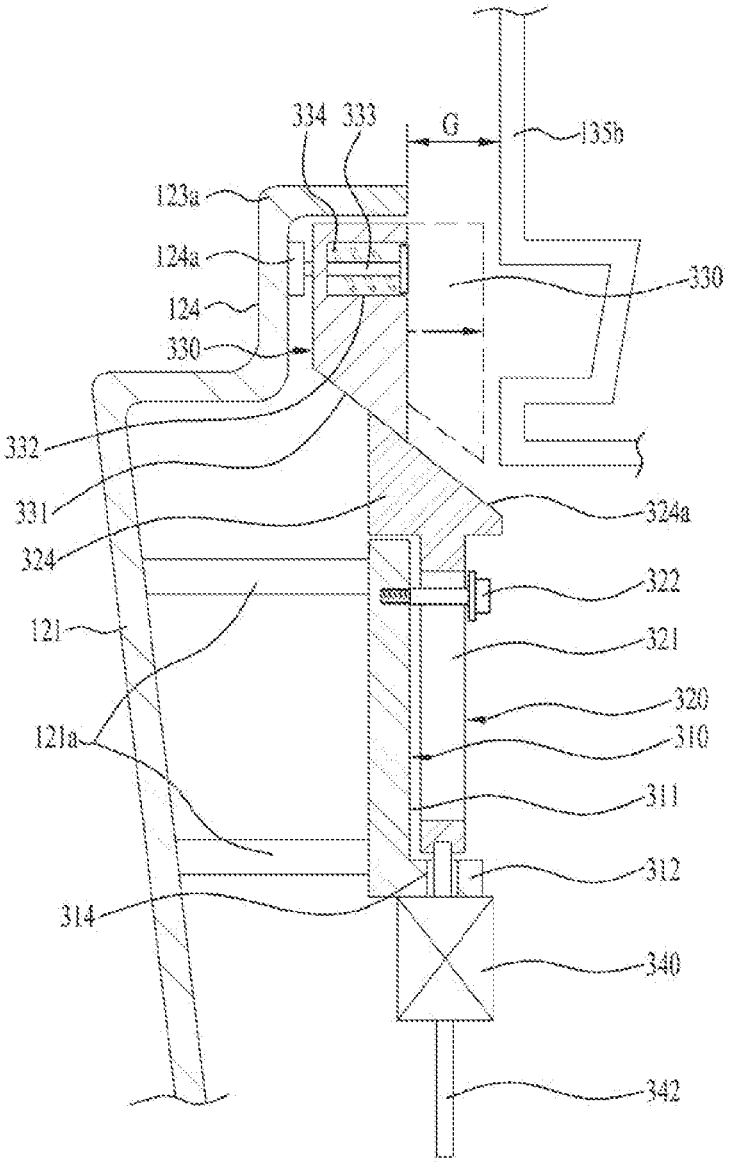
FIG. 10 is a cross-sectional view taken along line B-B' in FIG. 9.

FIG. 8 is a rear view illustrating the gap-shielding device according to another embodiment of the present disclosure. FIG. 9 is an enlarged view illustrating the gap-shielding device according to the embodiment of present disclosure. FIG. 10 is a cross-sectional view taken along line B-B' in FIG. 9.

As illustrated in the drawings, the gap-shielding device 300 according to the embodiment of the present disclosure includes a base 310 fixed to the fixing boss 121*a* provided on the rear surface of the front cabinet, a shielding end 330 provided along the outer circumferential surface of the cabinet introduction port 123 in the front cabinet 121 and movable in forward and backward directions of the front cabinet 121, a movable body 320, which is movable toward the center of the cabinet introduction port 123 with respect to the base 310 so as to move the shielding end 330 in the rearward direction of the front cabinet 121, and an actuator 340 configured to move the movable body 320.

The shielding end 330 is positioned at one side below the cabinet introduction port 123 in the front cabinet 121. Specifically, the shielding end 330 is positioned on the outer circumferential surface of the rib 123*a* formed at the cabinet introduction port 123. Preferably, the shielding end 330 is formed into an arc shape, which is positioned outside the rib 123*a* of the cabinet introduction port and extends from the center below the cabinet introduction port 123 at an angle of 90°.

The shielding end 330, which is intended to shield the gap G defined between the cabinet introduction port 123 (specifically, the rib 123*a*) and the lower weight balancer cover 135*b*, is formed into an arc shape corresponding to the shape of the inner circumferential surface of the cabinet introduction port 123.

The shielding end 330 is coupled to the front cabinet 121 so as to be movable in forward and rearward directions of the front cabinet 121. To this end, at least one shielding-end-holding portion 333 is provided along the outer circumference of the cabinet introduction port 123 of the front cabinet 121, and at least one slide holes 332 is formed in the shielding end 330 so as to correspond to the shielding-end-holding portion 333.

Here, the movement of the shielding end 330 in forward and rearward directions of the front cabinet 121 is limited to a predetermined distance by means of the shielding-end-holding portion 333 which extends through the slide hole 332. A spring 334 is provided between the slide hole 332 and the shielding-end-holding portion 333 so as to elastically bias the shielding end 330 toward the front cabinet 121 along the shielding-end-holding portion 333. Accordingly, when external force is not applied to the shielding end 333, the shielding end 330 is capable of being maintained in the state of being biased toward the front cabinet 121 using the elastic force of the spring 334.

The shielding end 330 is provided at the concave side thereof with a concave surface 335 having the same radius as the radius of the cabinet introduction port 123, and is provided at the convex side thereof with a sloping surface 331 such that the shielding end 330 is moved in the rearward direction of the front cabinet 121 when pushed by the movable body 320. Here, the sloping surface 331 is in contact with a slide sloping surface 324*a* of the movable body 320, which will be described later, so as to slide in a state of surface contact when the movable body 320 is moved.

The base 310 is fixed at one surface thereof to the fixing boss 121*a* by means of an additional fastening element and is provided at the other surface thereof with a moving surface 311 on which the movable body 320 is moved. The outer lateral side surface of the moving surface 311 is provided with a support 312 configured to guide the movement of the movable body 320.

Here, the support 311 may project from three outer lateral side surfaces of the moving surface 311, excluding the outer lateral side surface of the moving surface 311 that faces the cabinet introduction port 123, among the four outer lateral side surfaces of the moving surface 311. The two ends of the support 312 that face the cabinet introduction port 123 are provided with stop steps 313 configured to limit the movement of a shielding end 330 of the movable body 320 which will be described later.

Among the three support parts of the support 312 of the base 310, the support part that faces the cabinet introduction port 123 may be provided with an actuator 340 configured to move the movable body 320. Here, the actuator 340 may be embodied as a motor, a solenoid, or the like, and may be replaced with another component configured to generate power required to move the movable body 320.

Furthermore, among the support parts 312 of the base 310, the support part that faces the cabinet introduction port 123 may have formed therein a shaft hole 314 through which a drive shaft 342 provided at the movable body 320 extends. The movable body 320 may be moved toward the center of the cabinet introduction port 123 along the moving surface 311 of the base 310 by means of the drive shaft 342, which extends and moves through the shaft hole 314.

Here, the base 310 is positioned on a line which is inclined downwards at an angle of 45° with respect to a vertical line that extends through the center of the cabinet introduction port 123. In other words, the pair of gap-shielding devices 300 may be symmetrically positioned at two opposite sides below the cabinet introduction port 123.

Because the movable body 320 is placed on the base 310 and is moved in the radial direction of the cabinet introduction port 123, the movable body 320 is preferably positioned on a line which is inclined downwards at an angle of 45° with respect to a vertical line that extends through the center of the cabinet introduction port 123, in consideration of the moving direction of the movable body 320 and the shape of the shielding end 330.

The movable body 320 is formed into a shape corresponding to the inner lateral side surface of the support 312 formed at the base 310 so as to be placed and moved on the moving surface of the base 310. The movable body 320 has formed therein a moving slot 321 parallel to the moving direction of the movable body 320 (that is, the radial direction of the cabinet introduction port 123). The base 310 is provided with a guide 322, which extends through the moving slot 321 and is fixed to the base 310. Consequently, the distance that the movable body 320 is capable of being moved is limited by the guide 322 and the moving slot 321.

Furthermore, the end of the movable body 320 that faces the cabinet introduction port 123 is provided with a presser 324, which is in contact with the shielding end 330, which extends in the circumferential direction of the cabinet introduction port 123, and which moves the shielding end 330 toward the tub 130.

The end of the presser 324 is provided with a slide sloping surface, which is in contact with the sloping surface 331 of the shielding end. The shielding end 330 substantially shields the gap G between the front cabinet 121 and the lower weight balancer cover 135*b*.

As described above, the pair of gap-shielding devices 300 may be symmetrically positioned below the cabinet introduction port 123. In this embodiment, the pair of shielding ends 330 are symmetrically positioned based on a vertical line which extends through the center of the cabinet introduction port 123.

Consequently, because the pair of shielding ends 330 are symmetrically positioned at two opposite sides below the cabinet introduction port 123, the shielding ends 330 of the pair of gap-shielding devices 300 are capable of shielding and opening two opposite sides below the cabinet introduction port 123.

Hereinafter, the operation of the gap-shielding device according to another embodiment of the present disclosure will be described with reference to the accompanying drawings.

Figure 11:
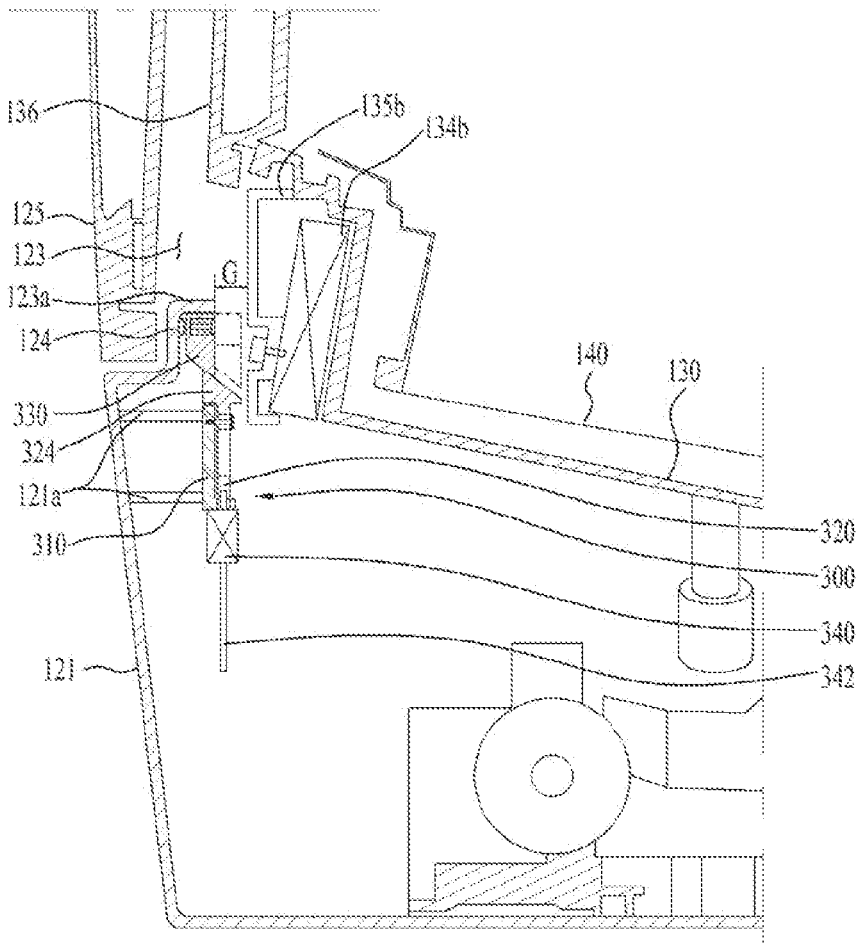
FIG. 11 is a schematic view illustrating the operation of the gap-shielding device according to another embodiment of the present disclosure.

FIG. 11 is a schematic view illustrating the operation of the gap-shielding device according to another embodiment of the present disclosure.

As illustrated in the drawings, the gap-shielding device 300 may be actuated in response to opening and closing of the cabinet door 125 or the tub door 136. In the following embodiment, the gap-shielding device 300 is described as being operated in response to opening of the cabinet door 125. However, the operation of the gap-shielding device 300 is not limited thereto, and the gap-shielding device 300 may be operated by detecting opening of the cabinet door 125 or the tub door 136.

First, the initial state of the gap-shielding device 300 is described. As illustrated in the drawings, in the initial state of the gap-shielding device 300, there is a need to ensure space in which the tub 130 is movable while the washing machine 100 performs a washing procedure, a rinsing procedure, a spinning procedure, a drying procedure, and the like in the state in which the cabinet door 125 and the tub door 136 of the washing machine 100 are closed.

Accordingly, when the cabinet door 125 is closed, the movable body 320 is moved in the radially outward direction of the cabinet introduction port 123 based on the base 310 by actuation of the actuator 340, and thus the pressure, which is applied to the sloping surface 331 of the shielding end 330 by the slide sloping surface 324*a* formed at the presser 324 of the movable body 320, is released.

Here, because the shielding end 330 is elastically biased toward the front cabinet 121 by the spring 334 provided in the slide hole 332 in the shielding end 330, the shielding end 330 is maintained in the state of being separated from the gap G between the front cabinet 121 and the lower weight balancer cover 135*b*.

Here, because the shielding end 330 is formed into an arch shape having the same radius as the radius of the cabinet introduction port 123, when the movable body 320 is moved, the entire shielding end 330 is moved toward the front cabinet 121 from the gap G between the cabinet introduction port 123 and the lower weight balancer cover 135*b* using the elastic force of the spring 334, thereby ensuring the gap G between the front cabinet 121 and the lower weight balancer cover 135*b*.

When a user opens the cabinet door 125 in order to introduce laundry into the washing machine 100 or take the laundry out of the washing machine 100, the cabinet door lock, configured to set the locked state of the cabinet door 125, is released.

Consequently, the actuator 340 of the gap-shielding device 300, which is electrically or physically connected to the cabinet door lock, is actuated to move the movable body 320 toward the center of the cabinet introduction port 123 in the radial direction of the cabinet introduction port 123. By virtue of the movement of the movable body 320, the slide sloping surface 324*a* of the presser 324 provided at the movable body 320 comes into contact with the sloping surface 331 of the shielding end 330 and thus the shielding end 330 is moved toward the tub 130 and becomes positioned in the gap G between the front cabinet 121 and the lower weight balancer cover 135*b*.

Here, because the shielding end 330 is formed into an arc shape having the same radius as the radius of the cabinet introduction port 123, when the movable body 320 is moved toward the center of the cabinet introduction port 123, the shielding end 330 is capable of shielding the gap G between the cabinet introduction port 123 and the lower weight balancer cover 135*b*.

In the above-described washing machine according to an embodiment of the present disclosure, since the structure between the tub and the cabinet is improved so as to prevent vibration and noise of the tub from being transmitted to the cabinet, it is possible to reduce generation of vibration and noise in the cabinet and to prevent the unpleasant vibration and noise from being transmitted to a user.

Furthermore, in the washing machine according to the present disclosure, it is possible to increase the capacity of the due to an improvement in the structure between the tub and the cabinet.

In addition, in the washing machine according to the present disclosure, it is possible to shield the gap defined the cabinet door and the tub door to thus prevent foreign objects from entering the gap between the cabinet door and the tub door.

Furthermore, in the washing machine according to the present disclosure, because the gap between the cabinet door and the tub door is selectively closed depending on whether the cabinet door is open or closed, it is possible to prevent foreign objects from entering the gap between the cabinet door and the tub door.

Although preferred embodiments of the present disclosure have been described in detail, those skilled in the art to which the present disclosure belongs will appreciate that the present disclosure can be implemented in various modifications within the idea and scope of the present disclosure, which is defined by the accompanying claims. Accordingly, the various modifications of the present disclosure falls within the scope of the present disclosure.

What is claimed is:

1. A washing machine comprising:

a cabinet including a front cabinet that defines a cabinet introduction port;

a tub disposed in the cabinet, the tub defining a tub introduction port that is coaxially positioned with the cabinet introduction port;

a cabinet door disposed at the cabinet and configured to open and close the cabinet introduction port;

a tub door disposed at the tub and configured to open and close the tub introduction port; and a gap-shielding device configured to open and close a gap defined between the front cabinet and the tub based on operation of the tub door, wherein the gap-shielding device comprises:

a base fixed to the front cabinet, a movable body provided at the base and configured to move relative to the base, an actuator provided at the base and configured to move the movable body toward the gap, and a shielding end configured to, based on the actuator moving the movable body toward the gap, move into the gap to shield the gap.

2. The washing machine of claim 1, further comprising:

a cabinet door lock provided at the cabinet and configured to set a locked state of the cabinet door; and a tub door lock provided at the tub and configured to set a locked state of the tub door.

3. The washing machine of claim 2, wherein the tub door lock is configured to set and release the locked state of the tub door based on the cabinet door lock setting and releasing the locked state of the cabinet door, respectively.

4. The washing machine of claim 2, wherein the actuator is configured to move the movable body based on the cabinet door lock setting and releasing the lock state of the cabinet door.

5. The washing machine of claim 2, wherein the cabinet door lock is configured to release the locked state of the cabinet door based on a user opening the cabinet door, and wherein the actuator is configured to, based on the cabinet door lock releasing the locked state of the cabinet door, move the movable body toward the cabinet introduction port.

6. The washing machine of claim 1, wherein the gap-shielding device is configured to operate based on opening and closing of the cabinet door, the gap-shielding device being configured to shield the gap based on the cabinet door being opened.

7. The washing machine of claim 1, wherein the shielding end includes a concave surface extending along a circumferential surface of the cabinet introduction port.

8. The washing machine of claim 7, wherein the shielding end is integrally formed with the movable body.

9. The washing machine of claim 7, wherein the shielding end is elastically biased toward the front cabinet, and the movable body is configured to push and move the shielding end toward the gap.

10. The washing machine of claim 9, wherein the front cabinet includes a plurality of shielding-end-holding portions, wherein the shielding end defines a plurality of slide holes corresponding to the plurality of shielding-end-holding portions, wherein the plurality of shielding-end-holding portions are respectively inserted into the plurality of slide holes and fixed to the shielding end, and wherein the gap-shielding device further comprises a plurality of springs that are respectively interposed between the plurality of slide holes and the shielding-end-holding portions and that are configured to bias the shield end toward the front cabinet.

11. The washing machine of claim 9, wherein the shielding end includes a sloping surface on a surface of the shielding end opposite to the concave surface, the sloping surface being configured to allow the shielding end to move toward the gap by pressure from the movable body.

12. The washing machine of claim 11, wherein the movable body includes a slide sloping surface at an end of the movable body, the slide sloping surface being configured to come into contact with the sloping surface and to move the shielding end.

13. The washing machine of claim 1, wherein the cabinet comprises a rib that extends from a circumference of the cabinet introduction port toward the tub, wherein the tub includes a weight balancer, and wherein the gap-shielding device is configured to shield a gap defined between the rib and the weight balancer.

14. The washing machine of claim 13, wherein the tub comprises a weight balancer cover that covers the weight balancer, and wherein the gap-shielding device is configured to shield a gap defined between the rib and the weight balancer cover.

15. The washing machine of claim 1, wherein the shielding end has an arch shape facing a circumferential surface of the cabinet introduction port.

16. The washing machine of claim 15, wherein a radius of curvature of the shielding end is equal to a radius of the circumferential surface of the cabinet introduction port.

* * * * *